United States Patent [19]

Uetani

[11] Patent Number: 4,458,787

[45] Date of Patent: Jul. 10, 1984

[54] GROUP SUPERVISORY CONTROL SYSTEM FOR ELEVATOR

[75] Inventor: Kenichi Uetani, Inazawa, Japan

[73] Assignee: Mitsubishi Denki Kabushiki Kaisha, Tokyo, Japan

[21] Appl. No.: 355,113

[22] Filed: Mar. 5, 1982

[30] Foreign Application Priority Data

Jul. 29, 1981 [JP] Japan ..... 56-118854

[51] Int. Cl.[3] ..... B66B 1/20

[52] U.S. Cl. ..... 187/29 R

[58] Field of Search ..... 187/29

[56] References Cited

U.S. PATENT DOCUMENTS 3,593,825 7/1971 Gieseler ..... 187/29 R 4,030,572 6/1977 Kaneko et al. ..... 187/29 R 4,058,187 11/1977 Jacoby et al. ..... 187/29 R

*Primary Examiner*—G. Z. Rubinson

*Assistant Examiner*—W. E. Duncanson, Jr.

*Attorney, Agent, or Firm*—Oblon, Fisher, Spivak, McClelland & Maier

[57] ABSTRACT

An elevator group supervisory control system for allocating elevator hall calls to elevator cars depending upon estimates given by processing of data indicative of travels of said cars, including a probability processor for determining an estimated future response probability based on predetermined travel data and an estimation processor for allocating hall calls to respective elevator cars based at least in part on the estimated future response probability.

12 Claims, 15 Drawing Figures

GROUP SUPERVISORY CONTROL SYSTEM FOR ELEVATOR

BACKGROUND OF THE INVENTION

1. Field of the Invention

This invention relates to a group supervisory control system for an elevator system.

2. Description of the Prior Art

In the typical group supervisory control system for an elevator system, when a hall call is registered, an elevator car suitable for responding to the hall call is selected depending upon data required for the group supervisory control, whereby the hall call is allocated to use car. This is the typical system which is described, for example, in U.S. Pat. No. 4,244,450. A registration of a hall call, a time for continuing a registration of a hall call, a registration of a car call, car load, car position and car direction are used as the data for the group supervisory control. These data are data at the present or past time. Even though the data are suitable at the present time, it is not always suitable in the future.

Referring to FIG. 1, one example will be illustrated.

In FIG. 1, the references (1)–(10) respectively designate 1st–10th floors; (a)–(c) respectively designate cars No. 1–No. 3; **(1*a*) designates up calls registered at a hall of the first floor (1); (3*b*), (5*b*), (7*b*)–(10*b*) respectively designate down calls registered at halls of 3rd (3), 5th (5), 7th (7)–10th (10) floors; (4*c*), (6*c*), (8*c*), (10C) respectively designate car calls for 4th, 6th, 8th and 10th floors. The car (a) is in up travel responding to the car calls (4*c*), (6*c*), (8*c*), (10*c*). The car (b) is in down travel at the 6th floor (6) under allocation of the down call (3*b*) at the 3rd floor. The car (c) is in down travel at the 7th floor (7) under allocation of the down call at the 5th floor. (The down calls (7*b*)–(10*b*) have not been given.) In a time zone for greater probability of down calls, there is great probability of the down call (7*b*)–(10*b*) just after the allocations for the cars (b), (c). Such allocation is given under the present condition of the car position and the calls. Even though the down calls (7*b*)–(10*b*) are given just after the moment, there is no car to respond to the down calls and persons who register down calls (7*b*)–(10*b*) at the 7th–10th floors have to wait for a long time. When the cars (b), (c) respectively stop at the 3rd and 5th floors (3), (5) in response to the down calls (3*b*), (5*b*), the car call at a lower floor (especially the first floor (1)) by the passengers entered at these floors. The cars (b), (c) should be in downward travel in response of the car call and accordingly, the responses to the down calls (7*b*)–(10*b*)** at the upper floors are delayed.

When many passengers are entered at the first floor (1), many car calls of the cars (b), (c) are registered at the first floor (1). The cars (b), (c) stop often and there is no response to the down calls **(7*b*)–(10*b*)** by any car for a long time. There is a further problem of passing these floors because of the full passenger load in the cars.

SUMMARY OF THE INVENTION

It is an object of the present invention to overcome the aforementioned problems and to provide a group supervisory control system for an elevator system, which provides an optimum allocation at the present time and in the future.

This and other objects are achieved in accordance with the present invention, by providing a group supervisory control system for an elevator system which allocates hall calls to cars depending upon estimations given by operations of data of travels of the cars or persons at the hall and which includes a probability processor for determining response probability based on specific prior travel data and an estimation processor for implementing car allocation at least in part on the determined probability.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 2 to 8 are diagrams of one embodiment of the group supervisory control system of the present invention for an elevator system, wherein, FIG. 2 is a block diagram for upward call allocation at the first floor, FIG. 3 is a block diagram of an estimate processor for the car No. 1 of FIG. 2, FIG. 4 is a block diagram of the processor for upward call time of arrival estimation time at the first floor of FIG. 3, FIG. 5 is a flow chart for operation steps, FIG. 6 is a block diagram of a processor for operating hall call occurrences, FIG. 7 is a block diagram of a processor for operating hall call occurrence probability and hall call response probability, FIG. 8 is a timing chart for operations of the processor shown in FIG. 6;

FIG. 11 is a block diagram of a processor for operating passenger load probability;

DETAILED DESCRIPTION OF THE PREFERRED EMBODIMENTS

Figure 1:
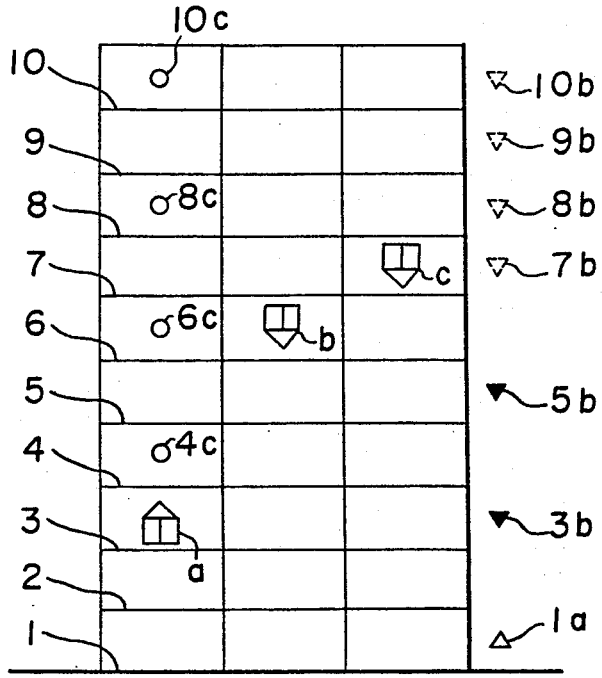
FIG. 1 is a schematic diagram showing the relation of the cars and the calls.

Referring to FIGS. 1 to 8 where like reference numerals designate identical or corresponding parts throughout the several views, one embodiment of the present invention for the allocation of the upward call **(1*a*) at the first floor will be illustrated. The suffixes A–C of the references respectively designate cars No. 1 to No. 3**. In the description, the suffixes are not shown sometimes to eliminate complicated references.

Figure 2:
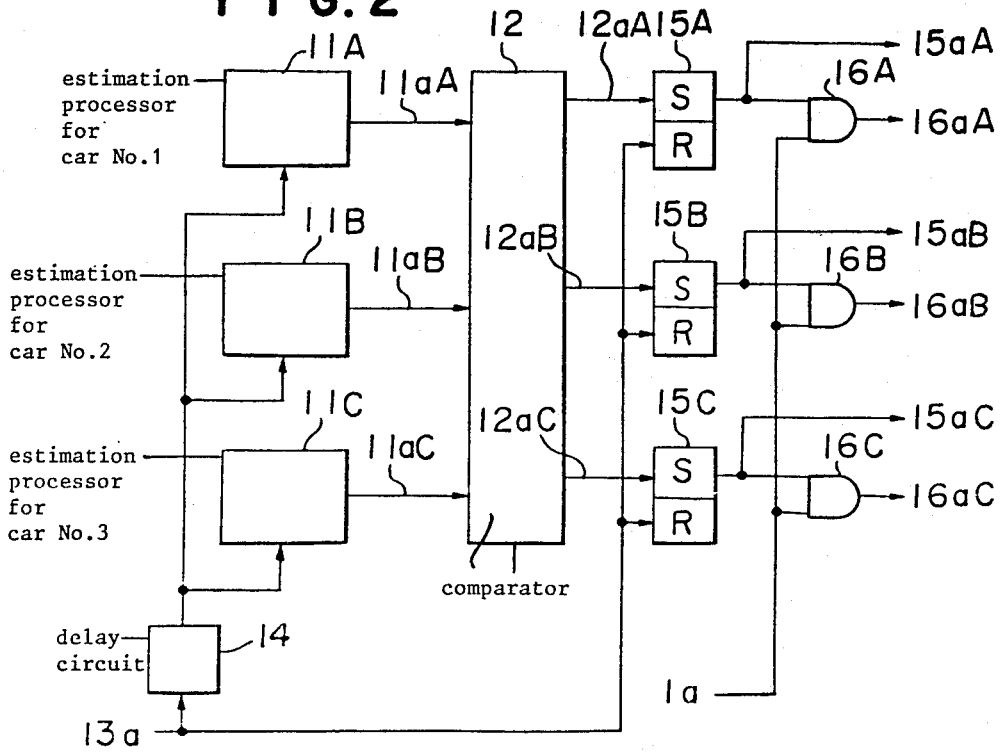
Figure 3:
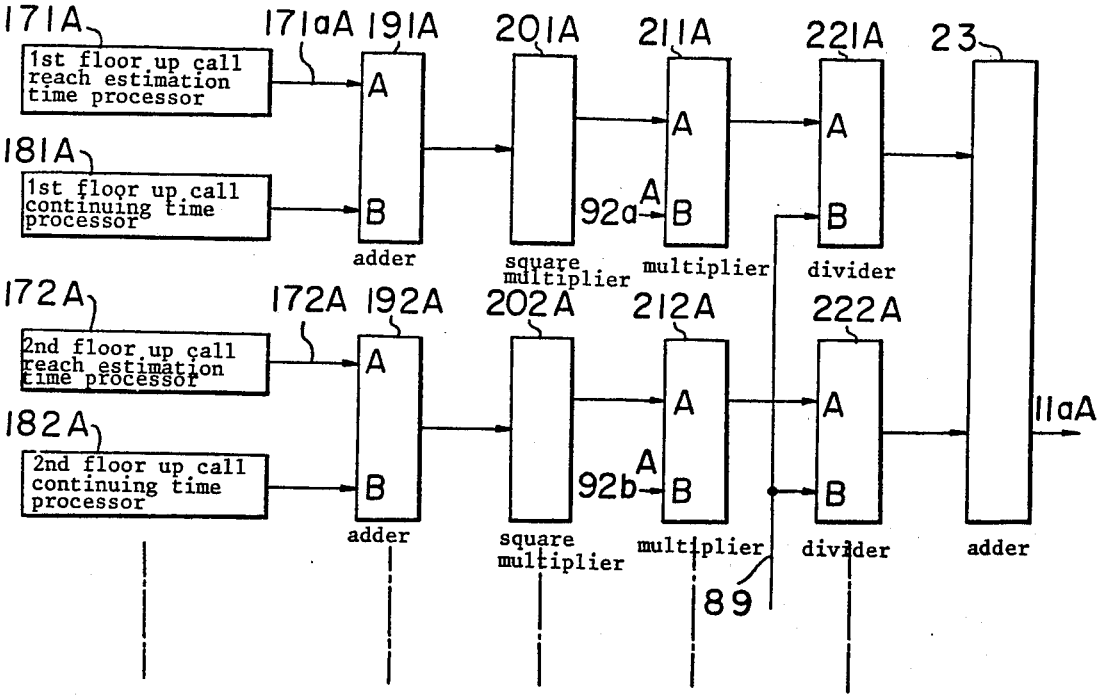

In FIGS. 2 and 3, the reference (11) designates an estimation processor for computing estimations **(11*a*) as the basis of the allocation of the hall calls; (12) designates a comparator which identifies the minimum input thereto and produces a corresponding output (12***a*) at an "H" logic level and corresponds to the minimum detection circuit (15) described in U.S. Pat. No. 4,244,450; (13*a*) designates an allocation operation timing pulse for up call at the first floor; (14) designates a delay circuit which outputs a logic "H" level for a predetermined delay time after having an input of "H" applied thereto; (15) designates a R-S flip-flop (referring to as memory); (15*a*) designates an output thereof as the upward call allocation signal at the first floor; (16) designates an AND gate; (16*a*) designates an output thereof as the upward call allocation signal to be sent to cars at the first floor; (171), (172) . . . respectively designate up-call time of arrival estimation processors for computing the time required for reaching the car (a) in response to the upward calls at the 1st, 2nd . . . floors which correspond, for example, to hall call registered time measuring circuit (11) described in U.S. Pat. No. 4,244,450; (171*a*), (172*a*) . . . respectively designate up call time of arrival estimations; and (181), (182) . . . respectively designate up call continuation timers for measuring times from the up call registration at the 1st, 2nd . . . floors. The processors (171), (172) . . . and the time processors (181), (182) . . . are provided for processing up calls at all floors. The references (191), (192) . . . respectively designate an adder for adding the input A and the input B; (201), (202) . . . respectively designate square multipliers; (211), (212) . . . respectively multipliers for multiplying the input A to the input B; (221), (222) . . . respectively designate dividers for dividing the input A by the input B; (23) designates an adder for adding the input; (92*a*), (92*b*) . . . respectively designate up call response probabilities for the 1st, 2nd . . . floors described below, (89) designates a constant thereof.

Figure 4:
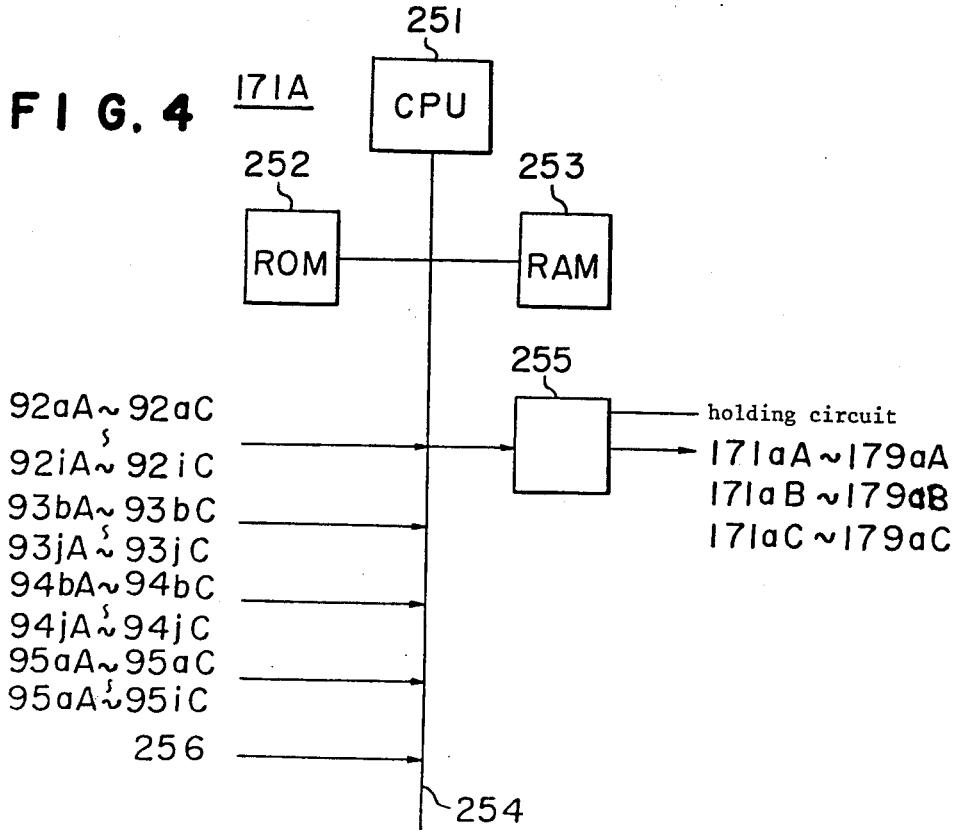

In FIG. 4, the reference (251) designates a central processing unit (referring to as CPU) in a microcomputer, for example, Intel 8085A; (252) designates a read only memory (ROM) which stores a program for the operations shown in FIG. 5 and data of constants (travel time between floors etc.) for example, Intel 2732 (4K×8 bits); (253) designates a read and write random access memory (RAM) for memorizing data such as operation results, for example, Intel 2114 (1024×4 bits); (254) designates a bus for data transmission; (255) designates a hold circuit for memorizing output signals given by CPU (251) for example, Intel 8212 (8 bit I/O port); (256) designates a car state signal for positions and directions of cars (a)–(c); (92*a*)–(92*i*) respectively designate up call response probabilities at the 1st–9th floors described below; (93*b*)–(93*j*) respectively designate down call response probabilities at the 2nd—10th floors; (94*b*)–(94*j*) respectively designate car call response probabilities in up travel at the 2nd–10th floors; (95*a*)–(95*i*) respectively designate car call response probabilities in down travel at the 1st–9th floors.

Figure 5:
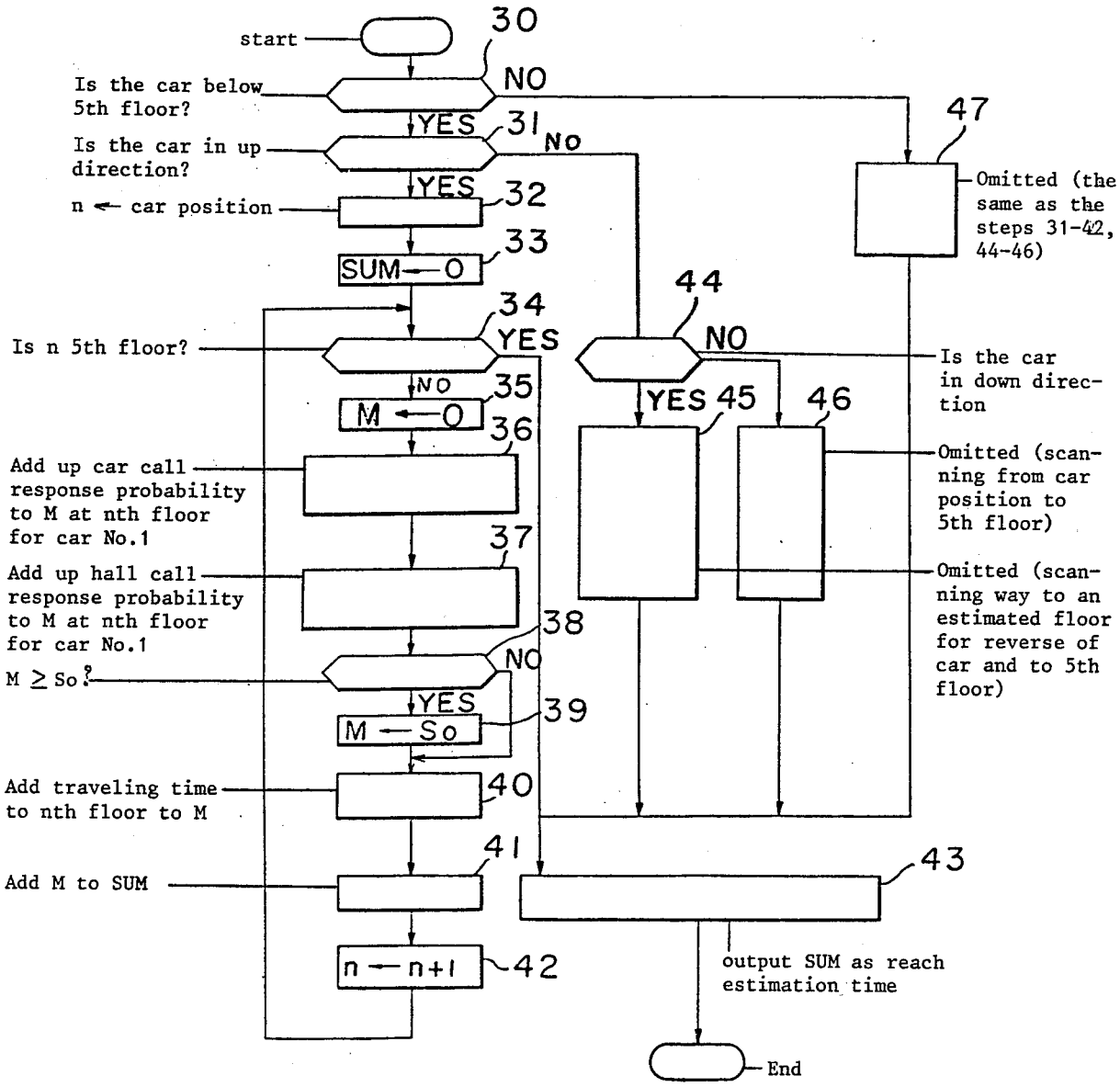

In FIG. 5, the references (30)–(47) designate operation steps of the estimated time of arrival processor (171).

Figure 6:
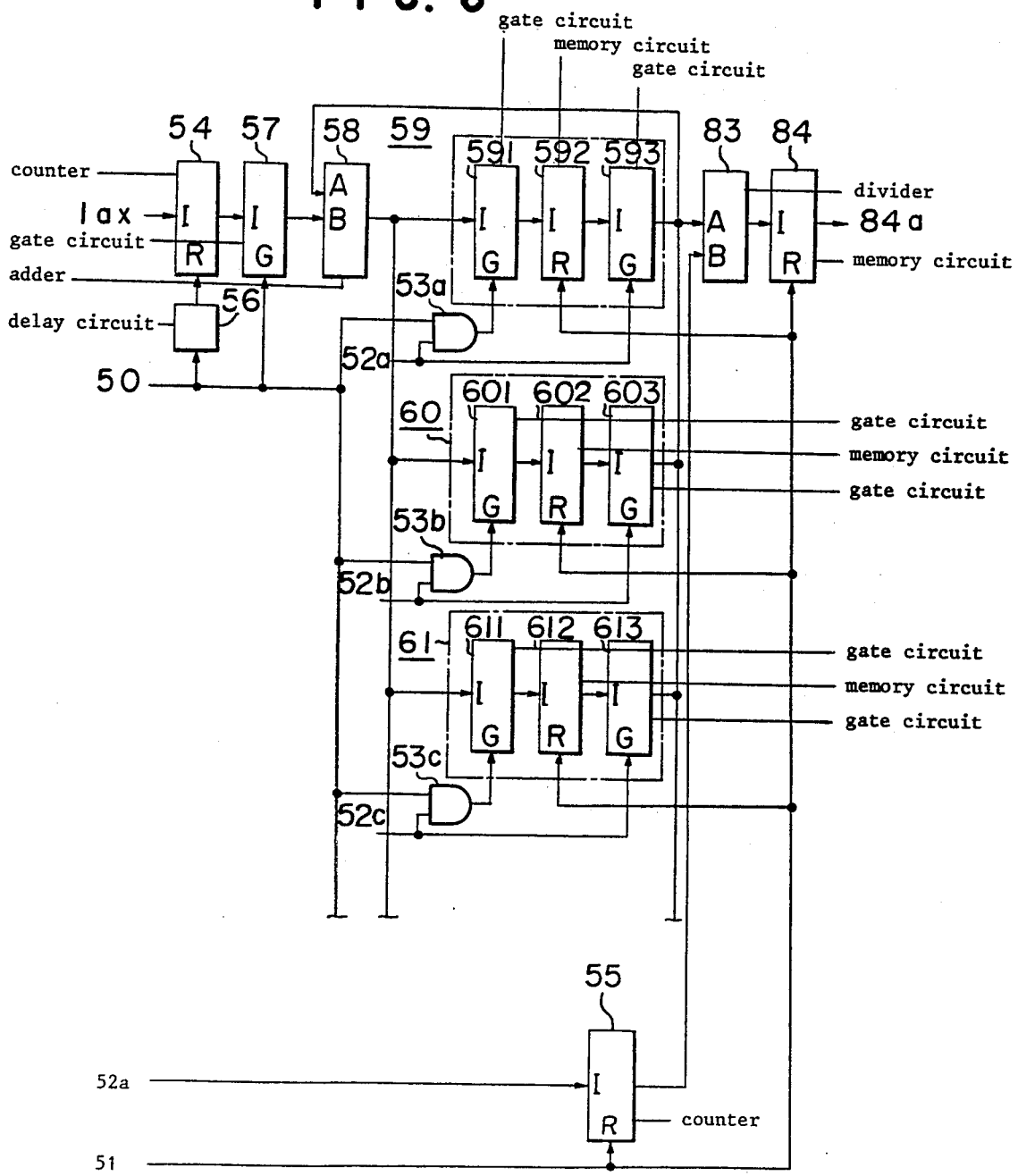
Figure 7:
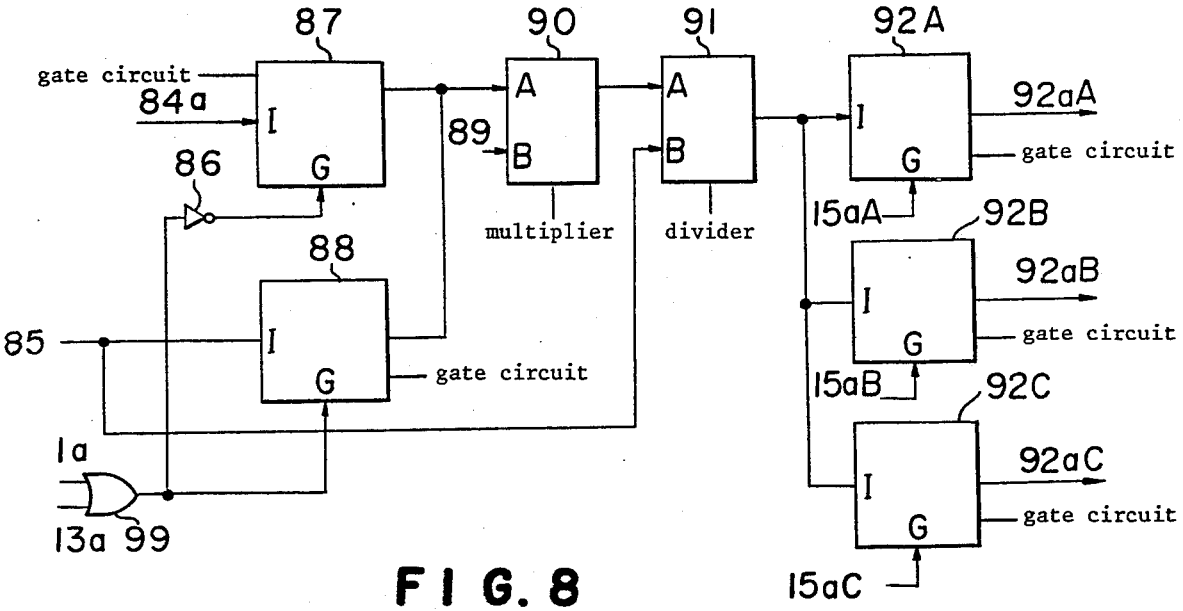
Figure 8:
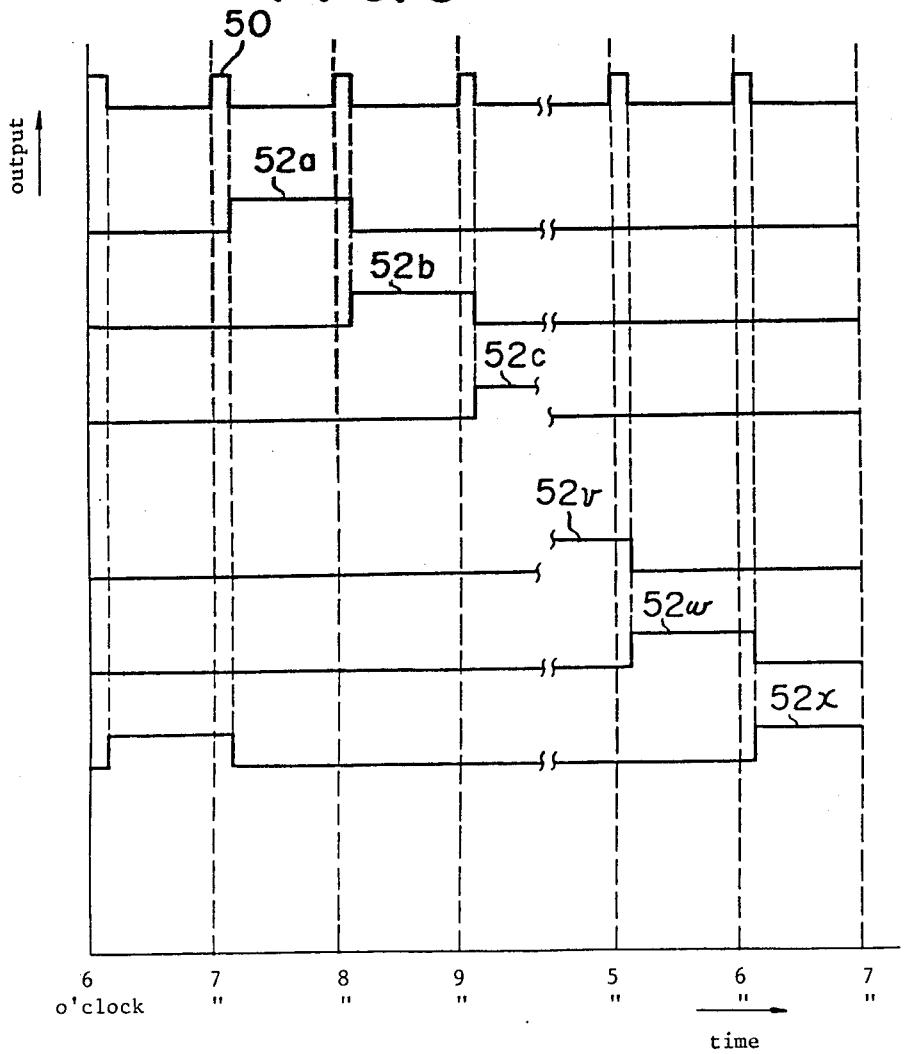

In FIGS. 6 to 8, the reference (1*ax*) designates an up hall button signal which is at the "H" level only for the time the up hall button is pushed at the first floor; (50) designates a time zone renewal pulse which changes to the "H" level at predetermined time intervals (such as each hour); (51) designates a reset signal which changes to the "H" level at the "zero" o'clock morning of each Sunday (for example 00:00 A.M.); (52*a*), (52*b*) . . . (52*x*) respectively represent time zone signals shown in FIG. 8. The signal (52*a*) which changes to "H" at 8 a.m. when the time renewal pulse (50) changes to "L" at 7 a.m. and is held at the "H" level until the pulse "H" is given again. The reference (52*b*) corresponds to the time zone from 8 a.m. to 9 a.m. In the same manner, the signals for 24 hours are applied. The references (53*a*)–(53*x*) respectively designate AND gates (to eliminate the gates with references (d)–(x)); (54), (55) respectively designate counters which count the inputs I and are reset when the input R changes to "H"; (56) designates a delay circuit which outputs "H" after a predetermined time delay after the input is changed to "H"; (57) designates a gate circuit which outputs the input I when the input G changes to "H"; (58) designates an adder for adding the input A and the input B; (59)–(82) respectively designates call times recording circuits in each time zone (the circuits (62)–(82) are not shown); (591–(821) respectively designate the gate circuits like the gate circuit (57); (592)–(822) respectively designate recording circuits which memorize the inputs I and output them and are reset when the inputs R change to "H", (593)–(823) respectively gate circuits as the gate circuit (57); (83) designates a divider for outputing the data given by dividing the input A by the input B; (84) designates a recording circuit as the recording circuit (592); (84*a*) designates an up call probability at the first floor as the output of the recording circuit (84); (85) designates a constant for showing the standard of probability of an up call at the first floor in the near future; (86) designates a NOT gate; (87), (88) respectively designate gate circuits which output the input I when the input G changes to "H"; (89) designates a constant time signal corresponding to a constant time such as 10 seconds; (90) designates a multiplier which outputs data given by multiplying the input A by the input B; (91) designates a divider which outputs data given by dividing the input A by the input B; (92) designates a gate circuit which outputs the input I as an up call response probability (92*a*) at the first floor when the input G changes to "H"; (99) designates an OR gate.

The operation of the example will be illustrated.

Referring to FIGS. 2 and 3, the up call allocation at the first floor will be briefly illustrated.

When the allocation operation timing pulses for the up call arrive at the first floor, the estimation processors (11A)–(11C) process output estimation signals (11*a*A)–(11*a*C) in the allocation of the up call (1*a*) at the first floor to the cars (a)–(c) depending upon the hall call reaching times and hall call continuing times of the cars No. 1–No. 3. The estimations are processed by the equation:

$$H=\Sigma Ti\bullet i \ldots \quad (1)$$

wherein H: the estimation of a total elevator service in a building; i: hall call (up calls at the 1st–9th floors and down calls at the 2nd–10th floors in FIG. 1); Ti: hall call i service estimated time (arrival estimated time+hall call continuing time).

The comparator (12) identifies the minimum of the estimations (11*c*A)–(11*a*C) to produce one output at the respective of the outputs (12*a*A)–(12*a*C). In the case of the car No. 2, the outputs (12*a*B) changes to "H" to set the memory (15B) and the allocation signal (15*a*B) changes to "H". When the up call signal (1*a*) at the first floor is kept at "H", the up call allocation output signal (16*a*B) as the output of the AND gate (16B) changes to "H" to have the car (b) respond to the up call (1*a*) at the first floor. The memory (15B) is kept in the set until resetting produced by changing of the timing pulse (13*a*) to "H".

As described below, the time of arrival estimate processors (11A)-(11C) perform the total estimation by a combination of a registered hall call estimation and an unregistered or future hall call estimation (possibly registering hall calls) depending upon the frequency of the hall calls. The estimated time of arrival is processed in consideration of the frequency of the unregistered or future hall calls and of the car calls. That is, hall calls and car calls which may be caused in the near future are considered and allocated to attain the optimum elevator service in a building.

The up button signal (1*ax*) changes to "H" each time the up button is pushed at the first floor and the counter (54) shown in FIG. 6 counts the pushing times. When the time zone renewal pulse (50) changes to "H" at 7 a.m., the gate circuit (57) opens to input the call times during 1 hour from 6 a.m. to 7 a.m. into the adder (58). When the time zone renewal pulse (50) changes to "L", the gate circuit (57) is closed. After a constant time, the output of the delay circuit (56) changes to "H" and the counter (54) is reset and the count is newly initiated. When the time zone signal (52*a*) change to "H", the gate circuit (593) opens to output the total call times during 1 hour from 7 a.m. to 8 a.m. On the other hand, the counter (55) counts the number of times of the time zone signals (52*a*). Therefore, the output of the divider (83) gives an average of the call times during the time zone. The data are memorized in the memory circuit (84) which outputs the data. The output of the gate circuit (593) is input into the adder (58) to add it to the call times during 1 hour before the moment. When the time zone renewal pulse (50) changes to "H" at 8 a.m., the output of the AND gate (53*a*) changes to "H" to open the gate circuit (591). Thus, the data of the adder (58) are memorized in the memory circuit (592). When the time zone signal (52*a*) changes to "L", the gate circuits (591), (593) are closed and the time zone signal (52*b*) changes to "H" to open the gate circuit (603). The total call times during 1 hour from 8 a.m. to 9 a.m. which are added until yesterday are output to output the average thereof from the divider (83). At a predetermined time of the morning of each Sunday, such as 12:00 a.m., the reset signal (51) changes to "H" to reset all call times in all time zones. As a result, the up call probability (84*a*) at the first floor corresponds to the average data for one week in each time zone.

The allocation operation timing pulse for up call (13*a*) at the first floor is in the "H" state. Thus, in FIG. 7, the output of the OR gate (99) changes to "H" and the output of the NOT gate (86) changes to "L" to close the gate circuit (87) and to open the gate circuit (88) and to input the constant (85) into the multiplier (90). The multiplier (91) calculates the time by multiplying 10 seconds and the divider (91) outputs data given by dividing the data by a constant. As it is clear from the description, the output of the divider (91) corresponds to 10 seconds in the case of "H" of the up call signal (1*a*) at the first floor and "H" of the timing pulse (13*a*). This corresponds to the time for stopping the car once. When both the up call signal (1*a*) at the first floor and the timing pulse (13*a*) are "L", the gate circuit (88) is closed to give "H" as the output of the NOT gate (86) and to open the gate circuit (87). Thus, the data of the number of up call (84*a*) at the first floor are input in the multiplier (90). The multiplication and division are performed in the same manner to output data from the divider (91). The output of the divider (91) corresponds to the estimation of the up call times at the first floor that is the time for the call probability. When the up call times (84*a*) are equal to a constant (85), the time for the call probability of 1 corresponds to 10 seconds. When the call times (84*a*) are less than the constant (85), the call probability is less than 1. The time for the call probability is shorter than 10 seconds. Now, the up call (1*a*) at the first floor is allocated to the car No. 2 and the allocation signal (15*a*B) is "H" to open the gate circuit (92B). The output of the divider (91) outputs as the up call response probability (92*a*B) at the first floor. If the up call (1*a*) at the first floor is allocated to the car No. 1 or No. 3, the response probability (92*a*A), (92*a*C) is output from the gate circuit (92A), (92C). The same performance is given for the up calls at each other floor. The up call response probabilities at the 2nd . . . 9th floors (92*b*A), (92*b*C) . . . (92*i*A)-(92*i*C) (see FIG. 4) are output. The same performance is given for the down calls. The down call response probabilities at the 2nd-9th floors (93*b*A)-(93*b*C) . . . (93*j*A)-(93*j*C) are output. The performance for the car calls is substantially the same though the circuits are slightly different. The up car call response probability at the 2nd-10th floors (94*b*A)-(94*b*C) . . . (94*j*A)-(94*j*C) and the down car call response probability at the 1st-9th floors (95*a*A-)-(95*a*C) . . . (95*a*A)-(95*i*C) are output.

The data of the response probabilities are input into the up call time of arrival estimation processors (171A), (172A) . . . to process the estimated arrival times (171*a*A)-(179*a*A) at the floors in the case of the allocation of the up call at the first floor by the steps shown in FIG. 5.

The operation of the up call estimated arrival time at the 5th floor will be illustrated.

In the step (30), it is decided whether the car is present below the 5th floor. In the case of the presence of a car below the 5th floor, it is decided whether the car direction is up or down in the step (31). In the case of the up direction, the car position is set to the data of the operation for the floor in the step (32). The memorized data SUM for the sum of the estimated arrival times at the floors change to zero in the step (33). The approach of the car to the 5th floor (5) is decided in the step (34). In the case of the nonreaching of the car at the 5th floor, the temporarily memorized data M for the estimated arrival time at the floor for operation change to zero in the step (35) the up car call response probability (time equivalent) at the nth floor is added to the data M in the step (36). The up call response probability (time equivalent) is added to the data M in the step (37). It is decided whether the data M are over the response probability limit $S_o$ (10 seconds) or not in the step (38). In the case of more than the limit $S_o$, the data M changes to $S_o$ in the step (39). In the case of less than the limit $S_0$, the step (40) is performed. The travel time to the nth floor is extracted from the ROM (252) to add it to the data M in the step (40).

The data M is added to the Sum in the step (41). The n is advanced for one floor in the step (42). Then, it is returned to the step (34) and the same steps are repeated to scan the up calls to the 5th floor. When it is decided to reach n to the 5th floor in the step (34), the data SUM is output in the step (43). The data SUM corresponds to the estimated arrival time for the car (a) responding to the up call at the 5th floor in alloation of the car (a) to the up call (1*a*) at the first floor.

If it is decided that the car is not in the up direction in the step (31), it is advanced to the step (44). If it is decided the car is in the down direction, it is scanned to the estimated floor in reverse of the car direction in the step (45) and is scanned to the 5th floor (5) in return. If the car is not in the down direction as the stopping, it is scanned from the car position to the 5th floor (5) in the step (46). If it is decided not to be present below the 5th floor in the step (30), the same scanning in the steps (31)-(42), (44)-(46) is performed in the step (47).

The same performance is given for the other floors beside the 5th floor (5). The estimated time of arrival for all floors are processed similarly regardless of the hall call. The same performance is given for down calls.

The same performance is given for the car No. 2 or No. 3 in the allocation of calls other than the up call (1*a*) at the first floor. The estimated time of arrival for the allocation of the car No. 1 to the up call (1*a*) at the first floor is memorized in the holding circuit (255) and output as the signals (171*a*A)-(179*a*A). The data are added to the outputs of the call continuing time processors (181A), (182A) . . . at the floors (call continuing times) in the adders (191A), (192A) . . . to give the service estimate times Ti for hall call. The data are squared by the square multipliers (201A), (202A) . . . . In the multipliers (211A), (212A) . . . , the data are multiplied into the data corresponding to response probabilities (92*a*A), (92*b*A) . . . . In the dividers (221A), (222A) . . . , the data are divided by the constant time (89) and the data are input into the adder (23). In the adder (23), the data are added to output the estimation (11*a*A).

As a result of the operation for allocation in the total estimation in FIG. 1, the following condition is found.

The cars (b), (c) as empty cars wait at any floor among the 6th-10th floors (6)-(10). Then, the down call (3*b*) at the 3rd floor is registered and is allocated to the car (b) to start the travel. Then, the down call (5*b*) at the 5th floor is registered just after that moment. In this case, the estimation is minimized by the allocation of the car (c) depending upon the call probability for the down call at the 7th-10th floors. The car (c) waits for the down calls (7*b*)-(10*b*). The estimation is minimized by the allocation of car (b) depending upon the call times for the down calls at the floors below the car (b). Thus, the down call (5*b*) at the 5th floor is allocated to the car (b). The up call (1*a*) at the first floor is also allocated to the car (b). As a result, when the down call (7*b*)-(10*b*) at the 7th-10th floor is given; the car (c) is responded. When the call probability (84*a*) is clearly found as the nature of the building, they can be constant.

Figure 9:
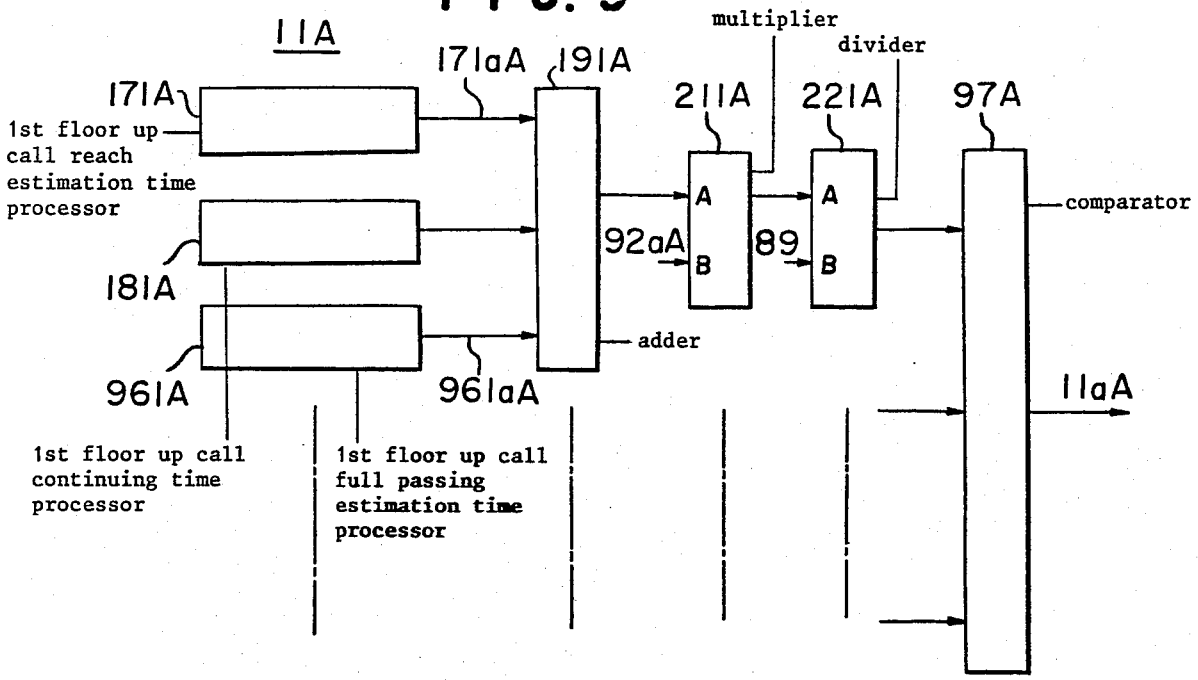
FIGS. 9 to 11 are diagrams of the other embodiment of the present invention, wherein, FIG. 9 corresponds to FIG. 3, and FIG. 10 corresponds to FIG. 5.
Figure 10:
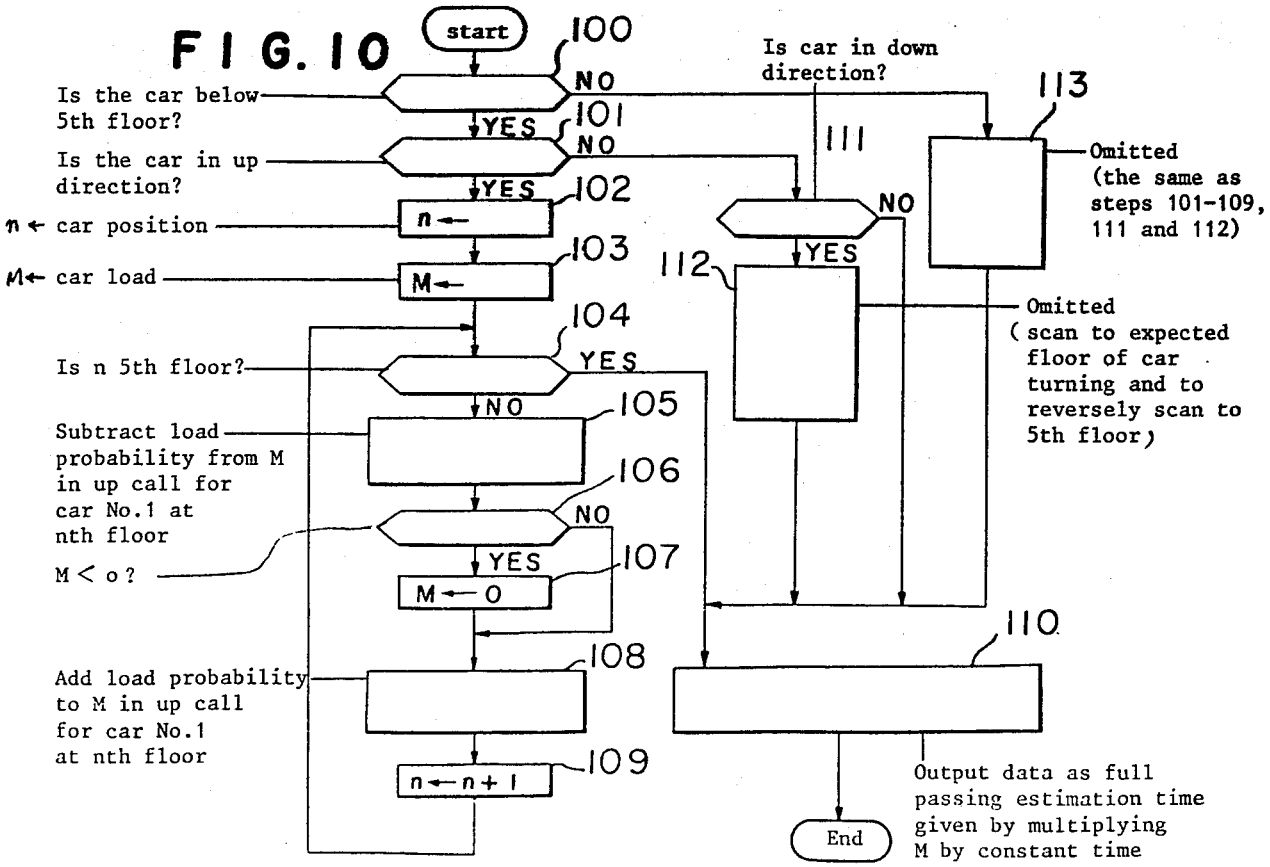
Figure 11:
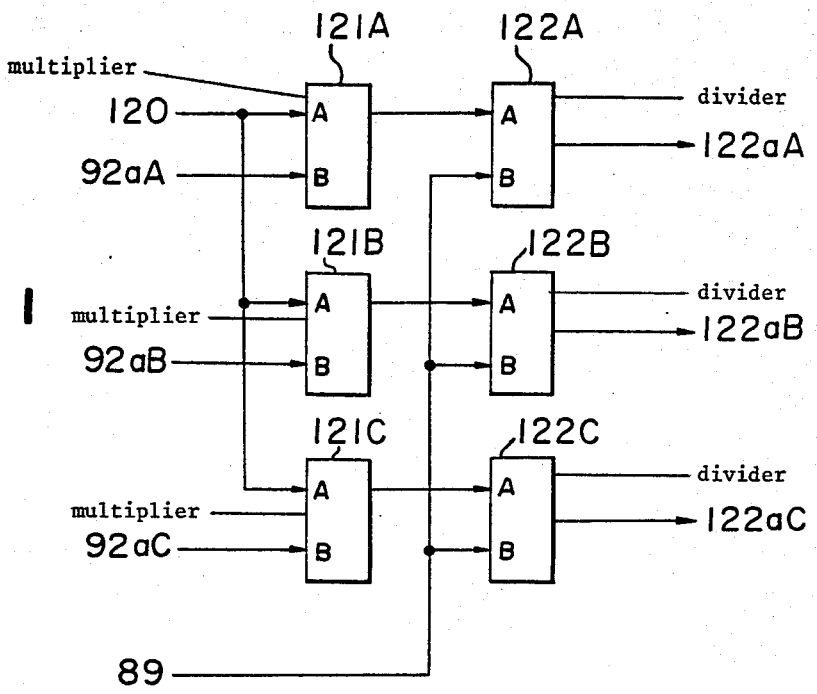

Referring to FIGS. 9 to 11, another embodiment of the present invention will be illustrated. FIGS. 2 and 4 to 8 are also referred.

In FIG. 9, the reference (961) designates an up call full passing estimated time processor for operating estimated time for full passing to the up call at the first floor (only the processor for call at the first floor is shown) which has the structure as the microcomputer of the processor (171) shown in FIG. 4. The reference (961*a*) designates an up call full passing estimated time; (97) designates a comparator for outputting the maximum input and the other parts are the same as those of FIG. 3.

In FIG. 10, the references (100)-(113) designate the steps of the full passing probability processor (961).

In FIG. 11, the reference (120) designates an increased load of entered passengers during the up call response at the first floor and is a ratio of an average data of the conventional increased load in the up call (1*a*) at the first floor to the full load (the circuit is not shown). The reference (121) designates a multiplier for multiplying the input B to the input A; (122) designates a divider for dividing the input A by the input B; (122*a*) designates the output thereof as the load probability in the up call at the first floor. The full passing estimated time processor (961A) computes the estimated time. The comparator (97A) outputs as the estimation (11*a*A), the higher value of either the estimated arrival time or the sum of the estimated arrival time and the hall call continuing time. The estimation (11*a*A) shows the up call estimation of the maximum time (worst service) in the allocation of the car (a) to the up call (1*a*) at the first floor. This is operated by the equation:

$$H = \max Til$$

wherein Til: service estimated time to hall call i (reaching estimated time + hall call continuing time + full passing estimated time).

When the up call response probability (92*a*B) of the car No. 2 is output in FIG. 7, the data of the output is multiplied by the increased load (120) by the multiplier (121B) and is divided by the constant time (89) by the divider (122B). The data is then output as the entered load probability (122*a*B). The same performance is given for the up calls at the other floors or the down calls. The same performance is also given for the remaining load probability. When the condition in the building is clearly understood, the entered increase load can be constant.

The entered or remaining load probabilities are input to operate the full passing estimated time in the steps shown in FIG. 10. The steps are similar to the steps in FIG. 5 in most steps and accordingly, only the difference will be illustrated.

After the steps (100)-(102), the car load is set in the temporarily memorized data M for obtaining the full time passing estimated time at the floor operated in the step (103). The up left load probability at the nth floor is subtracted from the data M in the step (105). It is then decided whether the data M is negative or positive in the step (106); if it is negative, the data M changes to zero in the step (107) whereas if it is positive, the step (108) is performed. The data M is added to the up entered load probability at the nth floor in the step (108). The up calls are scanned to the 5th floor by repeating the steps. In the step (104), if it is decided to reach to the 5th floor, the full passing estimated time given by multiplying M to the constant time (constant for converting the level of probability to the service time), is output in the step (110).

Figure 12:
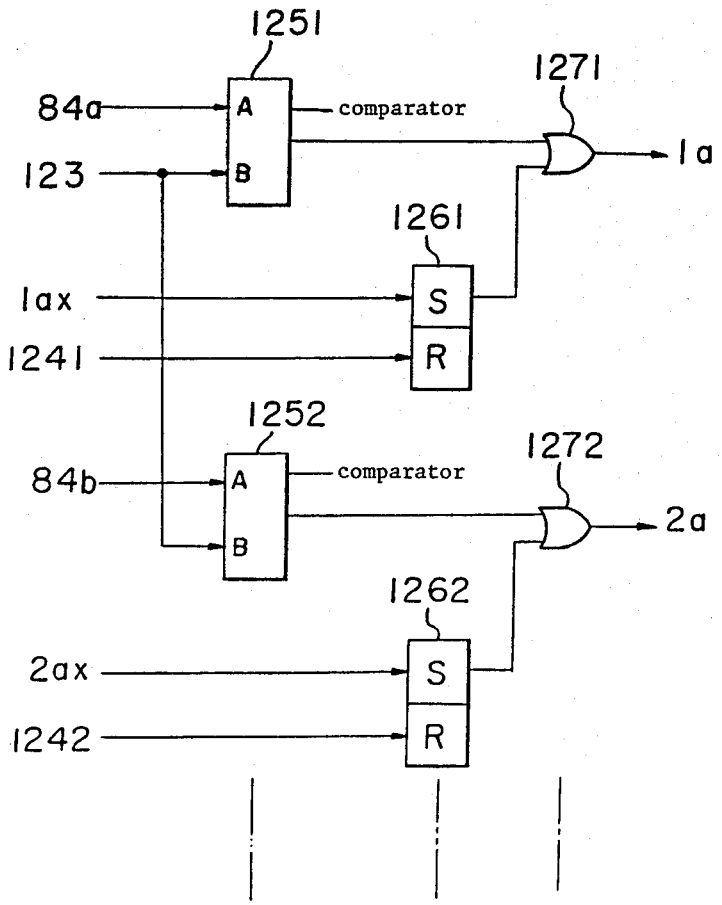
FIG. 12 is a block diagram of an automatic registration device for hall calls as another embodiment of the present invention.

Referring to FIG. 12, another embodiment of the present invention will be illustrated. This is combined with the aforementioned or other embodiment of the present invention.

In FIG. 12, the reference (2*a*) designates an up call signal at the 2nd floor; (2*ax*) designates an up button signal which is "H" during the time of pushing of the up hall button at the 2nd floor (not shown); (84*b*) designates an up call probability at the 2nd floor; (123) designates a rated up call probability: (1241), (1242) . . . respectively designate arrival signals which change to "H" upon the car reaching the 1st, 2nd . . . floors; (1251), (1251) . . . respectively designate comparators which output "H" in the case of the input ≧ the input B and "L" in the other case; (1261), (1262) . . . respectively designate R-S flip-flops (referring to as memory); (1271), (1272) . . . respectively designate OR gates.

When the up button at the first floor is pushed, the up button signal (1*ax*) changes to "H" to set the memory (1261). The up call signal (1*a*) at the first floor as the output of the OR gate (1271) changes to "H" to register the up call. When the car reaches to the first floor in response to the call, the arrival signal (1241) changes to "H" to reset the memory (1261). The up call signal (1*a*) changes to "L" to release the up call.

When the up call probability (84*a*) at the first floor is over the rated data (123), the output of the comparator (1251) is "H" and the output of the OR gate (1271) is "H" and the up call signal (1*a*) is "H". The same performance is given for the up calls in the other floors or the down calls.

When the call probability is over the rated data (123), the undecided data is entered as the decided data (automatic registration of calls), whereby the car can respond without pushing any call button for the hall call and the car call and various guide lanterns such as call registration lanterns, allocation lanterns and arrival indication lanterns. With regard to the car load, when the full passenger load is estimated, the allocation for the calls in the forward travel direction is stopped and the allocation is changed to reduce the service interruption caused by the full passenger load.

Figure 13:
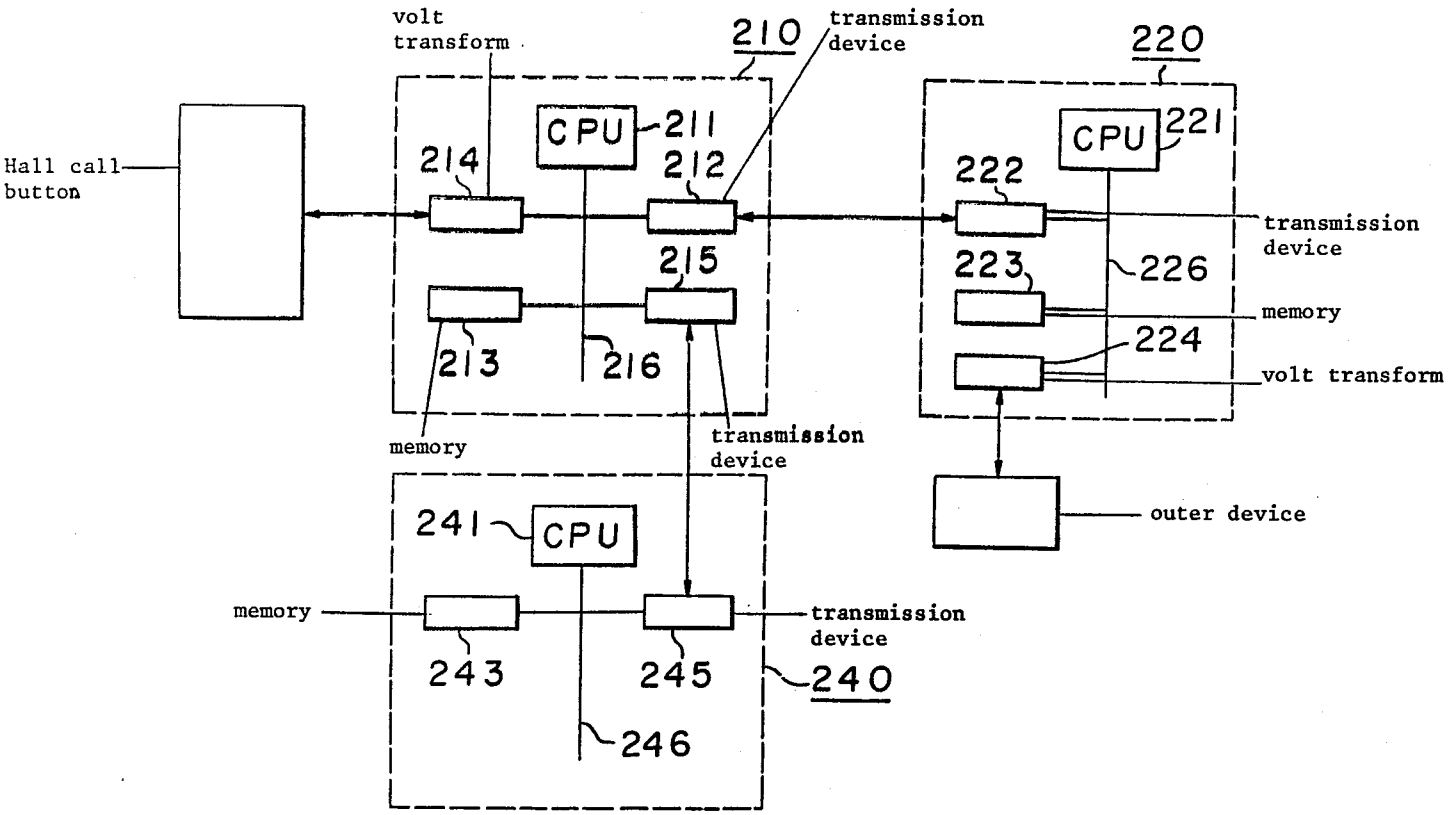
FIG. 13 is a block diagram of another embodiment of the group supervisory control system of the present invention.
Figure 15:
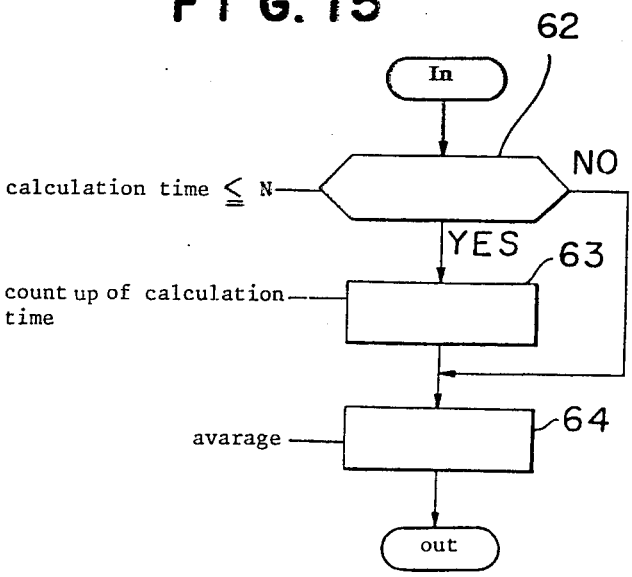
FIG. 15 is a flow chart of a processing routine in the step (255).

Referring to FIGS. 13 and 15, another embodiment is illustrated.

In FIG. 13, the reference (210) designates a group supervisory control device for group control of plural cars which includes a central processing unit (211) (referred to as CPU) made of microprocessors; a data transmission device (for example Intel 8251) connected through a bus-line (216) to CPU (211); and a memory (213) made of read-only memory (ROM) and a random access memory (RAM); and a volt transformer (214) connecting the bus-line (216) to a hall call button. In the ROM of the memory (213), the data shown in FIG. 2 (including FIGS. 3 to 5, FIG. 7 and FIGS. 9 to 12) are stored as programs and CPU (211) processes the data of the ROM.

The reference (220) designates a control device which controls movements of the cars by receiving commands of the group supervisory control device (210) and each control device is provided for each car (only one is shown in the drawing). The control device (220) includes the central processing unit (CPU) (221) made of microprocessors; a data transmission device (222) connected through the bus-line (226) and CPU (221) to be capable of transmission of the data to the transmission device (212) of the group supervisory control device (210); and a memory (223) made of ROM and RAM and a voltage transformer (224) connecting external instruments and the bus-line (226). The reference (240) designates a statistic processor for making statistics of calls at each floor and which include CPU (241); while reference (243) designates a memory made of ROM and RAM which memorize processing programs obtained by making statistics of calls, the memory (243) being connected to CPU (241) via the bus-line (246); and the group supervisory control device (210) coupled to the data transmission device (245) for data transmission.

ROM of the memory (243) stores data of FIG. 6 (including FIG. 8), processing data such as car call response probability, unloading probability and loading probabiliy as programs, CPU (241) processes the data of ROM of the memory (243).

Figure 14:
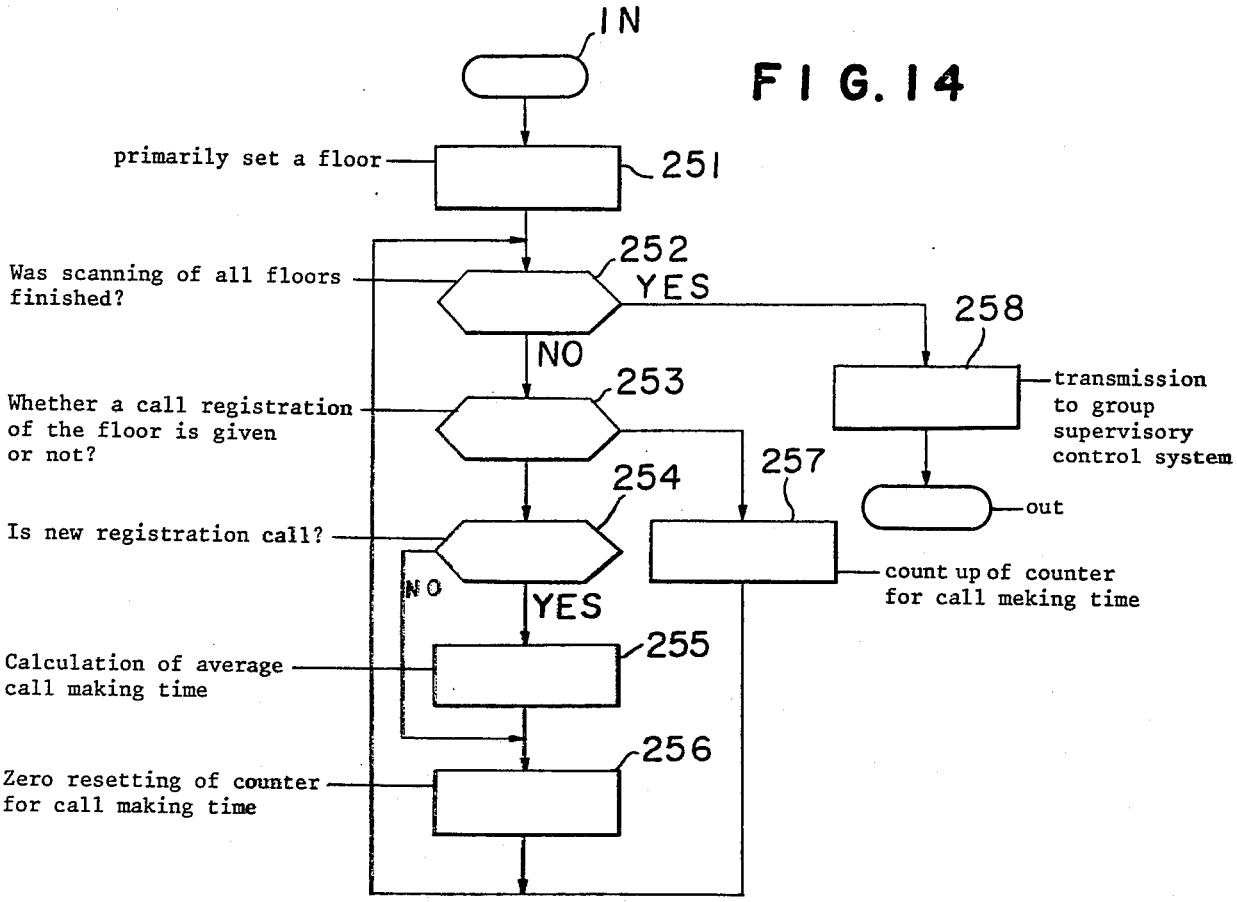
FIG. 14 is a flow chart for program data memorized in memory.

Referring to FIG. 14, the flow chart for the operation of the FIG. 13 system will be illustrated.

FIG. 14 shows the flow of data of the program memorized in the memory (243) of the statistic processer (240). The average time of the non-calling times in each floor is calculated. The step (251) primarily sets the floor when the calculation of average times of the non-calling times in each floor is started from the up call of the lowest floor. The step (252) determines whether the scanning of all floors is finished. When the calculation for all floors is finished, it shifts to the step (258). In the step (258), the processing of the data transmission of the calculated result through the transmission device (245) to the group supervisory control device (210) is performed. When the scanning for all floors is not finished in the step (252), it shifts to the next step (253) by shifting to the next floor. Since the floor for calculation is set in the step (252), it checks whether the call is registered in the floor, in the step (253). When no call registration is given, it shifts to the step (257) to count up the counter for the number of times of call making and to return it to the step (252). When a call registration is given as the result of the determination in the step (253), it shifts to the step (254) and it checks whether the call registration is newly registered or not. If it is a new call registration, an average call making time is calculated in the step (255) from the result of the count-up as the counter for call making times, and the counter for call making times is reset in the next step (256). If it is not a new call registration, it directly shifts to the step (256) without using the average calculation and the counter for call making times is reset to be zero. At the inlet (259) of the flow of FIG. 14, if it is designed to start by timer trap processing for each second by using an external timer device, for example Intel 8155 (not shown), the counter directly displays the time for non-call registration.

FIG. 15 shows the processing routine in the step (255) for calculation of the average call making time shown in FIG. 14. The step (262) is the processing step for checking times of the calculations of the average call making time. N is set, for example, to be 100. When the times are less than 100, it shifts to the step (263) to process the count up of the times. When the times are 100 or more, it shifts to the step (264).

The step (264) is a known processing step for average calculation to perform the following operation:

$$\text{New average} = \{(\text{calculation times}) \times (\text{old average}) + (\text{counts for call making time})\} \div \{(\text{calculation times}) + 1\}$$

In the processing step (264) shown in FIG. 15, the calculations are repeated. Therefore, infinite calculation times are considered. However, the proper counting is attained by connecting the step (262) to approach the calculation times to N if the calculation times are over N. Thus, the average call making time is calculated by calculating the times for non-call registration in each floor.

The average call making time, sometimes, can be defined as an average time from the call initiation to the next call initiation.

The average call making time given by the statistic processer (240) is transmitted to the group supervisory control device (210). The group supervisory control device (210) operates the following estimation of allocation, in view of feature calls.

$$\begin{pmatrix}\text{Estimation of allocation}\\ \text{in allocation of newly}\\ \text{registered call to car } (j)\end{pmatrix} = \Sigma f(Tij) + f(Tj) + \text{(registered call floor)}$$

$$\begin{pmatrix}\text{coefficient}\\ \text{for weight}\end{pmatrix} \times \Sigma f(Tij) - \text{(average all making time in floor } (j)) \text{ (unregistered floor)}$$

The estimation of calls in the unregistered floor is multiplied by the coefficient of weight and the product added to the registered hall call total to derive the total estimation.

In accordance with the embodiment, the estimation for future calls is considered in the total estimate in addition to the data of the estimation at the detected time, whereby a group supervisory control system for elevator having superior service can be provided.

In accordance with the present invention, the probability for resulting specific conditions in the travel information of the elevator system is estimated and operated and the estimation of the allocation of the hall calls is operated depending upon the probability. The precise future estimation is attained and waiting for a long time in the halls can be reduced by the optimum allocation of the hall calls.

Only the data having probability over the rated data are entered whereby the service for passengers is improved by the automatic registration of the calls and the service interruption caused by the full passenger load is reduced.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A group supervisory control system for an elevator system including plural elevator cars, wherein hall calls are allocated to said elevator cars, comprising:

probability processor means for producing a first time estimate based on usage and predetermined operating characteristics over predetermined time periods of said elevator cars, said first time estimate representing a probability response time of each elevator car to each hall call based on said usage and said predetermined operating characteristics;

registered hall call processing means for producing a second time estimate for each elevator car to respond to each hall call based on existing registered hall calls; and group supervisory control processor means for allocating elevator cars based on a predetermined combination of said first and second time estimates.

2. A group supervisory control system for an elevator system including plural elevator cars, wherein hall calls are allocated to said elevator cars, comprising:

probability processor means for producing a first time estimate based on usage and predetermined operating characteristics over predetermined time periods of said elevator cars, said first time estimate representing a probability response time of each elevator car to each hall call based on said usage and said predetermined operating characteristics;

registered hall call processing means for producing a second time estimate for each elevator car to respond to each hall call based on existing registered calls; and group supervisory control processor means for allocating elevator cars based on a predetermined combination of said first and second time estimates only when said first time estimate exceeds a rated level.

3. A group supervisory control system according to claim 1 wherein for estimation of future hall calls, the probability of hall calls obtained by past data is used as an estimation to allocate a car for each hall call.

4. A group supervisory control system according to claim 3 wherein in case that the probability of hall calls obtained by past data exceeds a predetermined rated data, a car is allocated under the consideration that a hall call has taken place at the floor at which the call has been made.

5. A group supervisory control system according to claim 1 wherein in estimation of waiting time for a hall call when a car is to be allocated, time for car stop is added based on the response probability obtained by past data calculation with respect to future hall call estimation and registered hall calls to process the arrival estimation time required to be responsible to a hall call.

6. A group supervisory control system according to claim 1 wherein for an estimation of full passing when a hall call is registered to allocate a car, a calculated change of the remaining load and the entered increase load is taken into account dependent on the entered or remaining load probability obtained by past data.

7. A group supervisory control system according to claim 1 wherein said probability processor means is provided for each floor to compute arrival estimation time of cars in response to each hall call at each floor, and a registered hall call processing means is provided for each floor to measure the continuing time for the hall call registered at each floor.

8. A group supervisory control system according to claim 7 wherein said probability processor means at each floor and said registered hall call processing means at each floor are provided in combination and the outputs from both processing means are combined for processing.

9. A group supervisory control system according to claim 8 wherein data obtained by processing the outputs from said both processing means provided at each of the floors is supplied to an adder to be summed.

10. A group supervisory control system according to claim 9 wherein both said probability processor means at each floor and said registered hall call processing means at each floor correspond to each of cars.

11. A group supervisory control system according to claim 10 which comprises a comparator which compares data as operation results for each car to select a car suitable for responding to a hall call.

12. A group supervisory control system according to claim 11 wherein a car having the minimum resultant data of operation is allocated for a specific hall call.

* * * * *